United States Patent [19]

Merkle

[11] 4,016,732

[45] Apr. 12, 1977

[54] FILAMENT MONITORING DEVICE

[75] Inventor: Eberhard Merkle, Stuttgart, Germany

[73] Assignee: Wilh. Bleyle KG, Stuttgart, Germany

[22] Filed: July 18, 1975

[21] Appl. No.: 597,148

[30] Foreign Application Priority Data

Aug. 7, 1974 Germany ..... 2438006

[52] U.S. Cl. ..... 66/163; 66/161; 57/81; 200/61.18

[51] Int. Cl.[2] ..... D04B 35/12

[58] Field of Search ..... 66/160, 161, 162, 163; 57/81; 200/61.18, 61.13, 61.14

[56] References Cited

UNITED STATES PATENTS

| | | | |
|---|---|---|---|
| 3,764,773 | 10/1973 | Merkle | 66/163 |
| 3,863,466 | 2/1975 | Barone | 66/163 |

FOREIGN PATENTS OR APPLICATIONS

| | | | |
|---|---|---|---|
| 1,269,285 | 5/1968 | Germany | 66/163 |
| 1,261,267 | 2/1968 | Germany | 66/161 |

*Primary Examiner*—Mervin Stein
*Assistant Examiner*—A. M. Falik
*Attorney, Agent, or Firm*—Edwin E. Greigg

[57] ABSTRACT

A filament monitoring device for knitwear manufacturing machines and of the kind having a filament guide arranged to move out of its operating position when a predetermined filament tension is exceeded and to be returned into the operating position with a force less than the breaking tension of the filament for automatic reapplication of the machine drive is, according to the invention, characterized by the provision of a guided slide member carrying only the filament guide and the armature of a magnet which holds the slide member in the operating position, and by a cable connection between the slide member and a return piston which is reciprocable in a compressed air cylinder and adapted to return the slide member to the operating position.

9 Claims, 13 Drawing Figures

FILAMENT MONITORING DEVICE

The invention relates to a filament monitoring device for knitwear manufacturing machines, wherein the filament is conducted through a filament guide, which is guidedly movable out of the operating position when a predetermined filament tension is exceeded and wherein a compressed air cylinder with a return piston is provided, by means of which the filament guide is returnable into the operating position with a force less than the breaking tension of the filament, so that the machine drive is automatically reapplied.

In a known filament monitoring device of this kind (German Offenlegungsschrift 2,202,423) a filament guide is secured to the longer arm of a two-armed lever arm. The other arm is provided with a catch device for holding the lever in the operating position. The lever itself is, via its pivot axis, connected to a chain wheel, over which a chain connected to the return piston of the compressed air cylinder is led. The lever and the transmission elements between the lever and the piston exert large inertia forces on the filament upon actuation of the device and are of elaborate design.

The object of the invention is to provide a filament monitoring device of the above-mentioned kind which is not elaborate, exerts little stress on the filament and is very sensitive.

This object is, according to the invention, fulfilled by providing only the filament guide and the armature of a magnet on a guided slide member for the purpose of holding the slide member in the operating position and connecting the slide member to the return piston by a cable.

Because the slide member is provided only with the filament guide and the armature of the magnet, the slide member can take the form of a very light and small component. By connecting the slide member with the piston by means of a cable, the inertia forces for the transmission elements are also not significantly increased. This means that very finely metered compressed air pulses can be employed for detaching filament layers caught up on the reel. The light slide member can readily be conducted along a slide wire almost without any frictional losses. The U-shaped configuration of the slide member and the application of a filament monitoring arm in the region of the filament between two limbs of the slide member make a very simple and compact construction of the filament monitoring arm possible and actuation of the filament monitor not only in the course of slidable displacement of the slide member when the filament is excessively tensioned but also when the filament breaks. The connection of the return piston to the armature which is secured to the slide member and which is associated with the magnet, through the magnet for holding the slide member, makes it possible to apply the return force exerted by the return piston precisely at the same point at which the holding force of the magnet acts. The arrangement of the compressed air cylinder parallel to the path of the slide member makes it possible to design the entire equipment in a relatively space-saving manner and at the same time to provide a long run-out for the slide member. The arrangement of the compressed air cylinder with the associated bobbin on a console which is arranged above the machine and is downwardly pivotable makes it possible, on the one hand, to accommodate the entire filament monitoring device in a space above the machine and thereby to effect a saving in the floor space required for the machine, whilst, on the other hand, maintaining the equipment, in the event of faulty running of the filament which has to be corrected manually, at a convenient working height by pivoting the entire equipment downwards. The saving in the floor space required for operation of the machine, which can thereby be achieved, is exceptionally large. These advantages are further increased and the design simplified, by connecting each of two slide members by a cable to a common piston. The construction of the filament guide in the form of an eye which is open on one side and which is closed by a brush which prevents the filament from slipping out of it makes it possible firstly simply to insert the filament, to lead it securely during operation, even to remove from it any foreign matter which may be present, whilst it is being inserted, and also to remove it again. The air current flowing in the opposite direction to the direction of movement of the filament provides continuous tensioning by a very finely metered and relatively small force.

Embodiments of the invention and their advantageous developments will now be described with reference to the accompanying drawings, in which.

Figure 1:
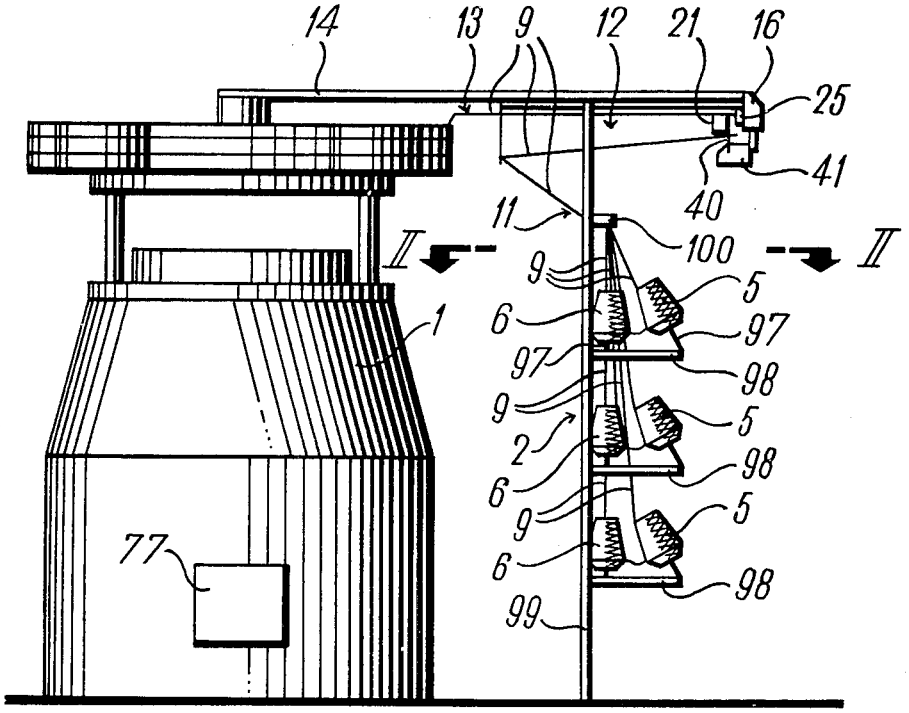
FIG. 1 shows a first embodiment (in the form of a diagrammatic representation)

FIG. 1 shows diagrammatically the arrangement of a circular knitting machine with a bobbin holder 2. As will be seen from FIG. 2, the circular knitting machine is provided on one side with a plurality of bobbin holders. On the other side of the machine further bobbin holders may appropriately be provided. Each of these bobbin holders carries bobbins 5, 6 and 7, 8 respectively, which are arranged in pairs in a plurality of planes. The arrangement of two mutually adjacent bobbins 5, 6 and 7, 8 respectively is such that the end of the filament 9 on the bobbin 5 is connected to the start of the filament 9 on the bobbin 6, so that, when the yarn on the bobbin 5 is used up, the filament on the bobbin 6 is also withdrawn without any further replacement step.

Figure 7:
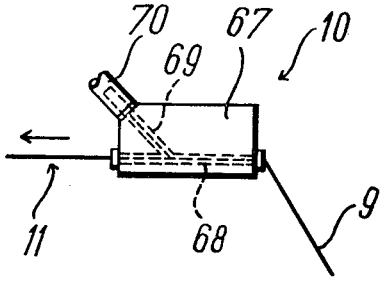
FIG. 7 shows a filament air brake as used in the embodiment according to FIG. 1.

From the bobbins 5 on the bobbin holder 2 the filaments 9 are withdrawn upwardly; they are led initially through a block 100, in which a plurality of filament air brakes 10 (c.f. FIG. 7), viz. one for each yarn, are provided. Each filament 9 emerging at the location 11 from the block 100 or from a filament air brake 10 provided therein, is then led into a filament monitoring device, designated diagrammatically in FIG. 1 by 12, proceeds therethrough and is then presented to the circular knitting machine at the location 13 by means of so called Rosen-feeders (not shown). As a rule, a single circular knitting machine of this kind processes 48, in special cases up to 120, yarns simultaneously.

Figure 3:
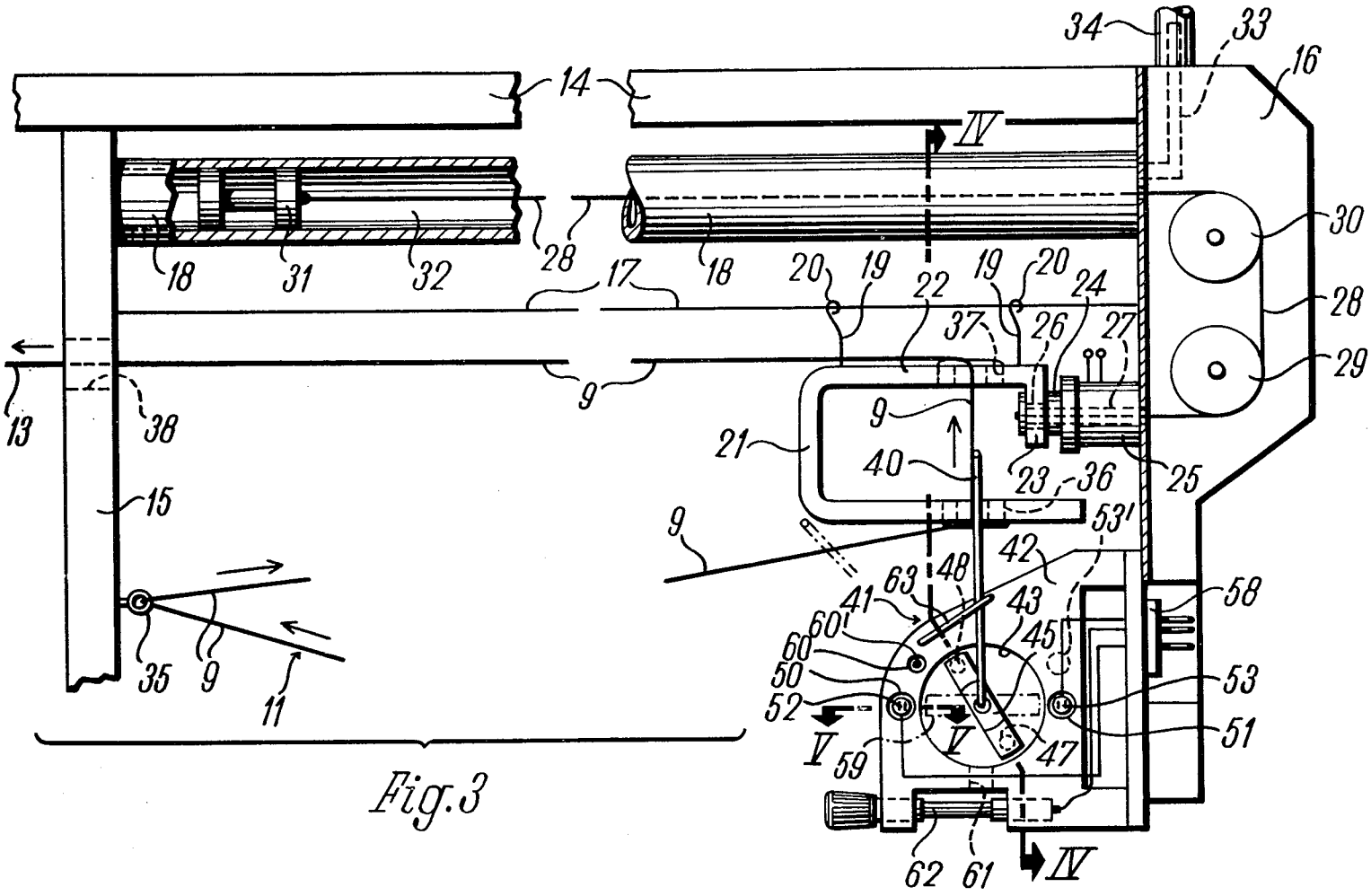
FIG. 3 is a detailed representation of the yarn path monitoring device according to FIG. 1.

The filament monitoring device 12 is shown in detail in FIG. 3. A relatively long (approximately 2m) jib 14, which is arranged on the top of the circular knitting machine 1, is provided on one side with a bridge 15 and on the other side with a support member 16. A slide wire 17 and a tube 18, which represents the compressed air cylinder, extend between the bridge 15 and the support member 16. A slide member 21 in the form of a filament-conducting element, is slidably arranged on the slide wire 17 and guided by means of two hooks 19 with eyes 20 at their ends. The slide member 21 is of substantially U-shaped cross-section, one of its limbs 22 being bent at right angles to the slide wire 17 at its end 23 and carrying at this point a small metal plate 24.

A magnet 25 is provided on the support member 16. It is an electromagnet. The holding force which is exerted by it and which, by means of the current regulator 82, (FIG. 8) is set, by adjustment of the current supplied to it, to a predetermined value, acts on the small metal plate 24 which forms the armature of the magnet 25 and retains the slide member 21 in the operating position shown.

A cable 28 is secured to the end 23 of the limb 22 of the slide member 21, led through an aperture 26 in the small metal plate 24 and an aperture 27 in the magnet 25 and, reorientated via two pulleys 29 and 30 arranged on the support member 16, introduced into the tube 18 and there connected to the piston 31 which is slidably displaceable in the tube 18. The piston 31 is (in FIG. 3) slidably displaceable in the tube 18 to the left, when the chamber 32 to the right of the piston 31 is subjected to compressed air. This is applied via a conduit 33 and a compressed air connection 34 (c.f. also the pneumatic circuit diagram according to FIG. 9).

As is yet to be explained, the piston acts as a return piston.

The filament 9, which enters the filament monitoring device 12 from the location 11 (c.f. FIG. 1) is first led to a reorientation eye 35 which is secured to the bridge 15. Then the filament is led somewhat obliquely into the eye 36 in the lower limb of the slide member 21 and thence vertically upwards and through a further eye 37. The two eyes 36 and 37 guide the filament in the slide member. They therefore constitute the filament guide proper. Thence the filament is led horizontally, i.e. parallel to the slide wire and to the tube 18 to the left and thence through an aperture 38 in the bridge 15. Thence, i.e. from the location 13 (c.f. FIG. 1) the filament is led via known Rosen-feeders into the circular knitting machine. If now the tension of the filament 9 is greater than the pre-set holder force of the magnet 25, by reason of some fault (adhesion between the filaments on the bobbin caused by electrostatic or mechanical attraction, tufting, thread ends etc.), the slide member 21 is drawn to the left.

The filament monitoring arm 40, which is part of a filament monitor 41 and which defines a sensor sensing the position of the filament in the slide member, rests against the filament 9 in the region between the apertures 36 and 37 in the slide member 21.

Figure 4:
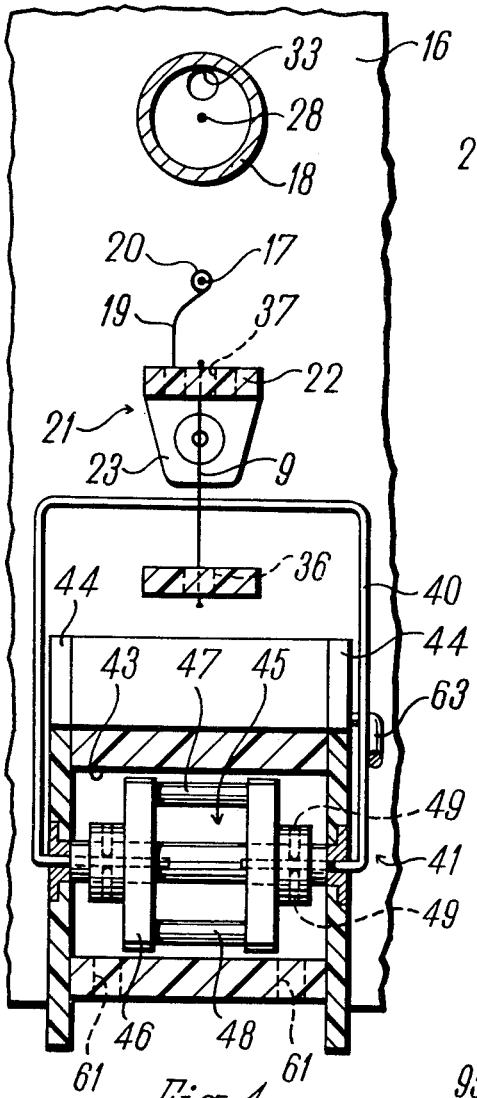
FIG. 4 is a section on the line VI—VI in FIG. 3.

The filament monitor 41 is arranged in a block 42 which is made of plastics material, has a round aperture 43 and is boxed in by plates 44. In the aperture 43 an armature 45 is provided which, as can be seen in FIG. 4, is defined by an I-shaped member 46; between each of the open ends of the I-shaped member 46 permanent magnets 47 and 48 are provided. At its two ends the I-shaped member is provided with apertures into which the bent ends of the wire stirrup 40 which is of substantially rectangular shape engage and in which they are clamped by means of clamping screws 49. The support stirrup 40 is rotatably supported in the two plates 44. In this bearing arrangement the armature and the wire stirrup 40 are rotatable together, viz. from the operating position shown in FIG. 3 in full lines to the switching position 59 shown in FIG. 3 in dash-dotted lines.

Figure 5:
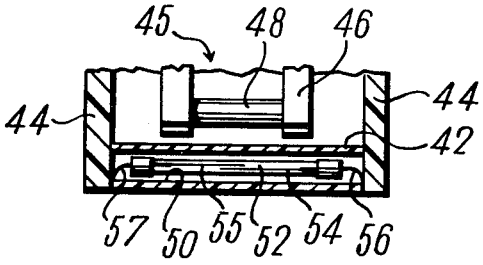
FIG. 5 is a section on the line V—V in FIG. 3.

The block 42 has two bores 50 and 51, each of which is provided with a reed-switch 52 and 53 respectively. They have two contact tongues 54 and 55 (c.f. FIG. 5) which are provided with connections 56 and 57 of magnetically conductive material. If the permanent magnet 48 is juxtaposed to the free ends of the contact tongues, then they close. The connections 56 and 57 of the reed-switch 52 and the corresponding connections of the reed-switch 53 are taken to a connection plug 58. Closure of the contacts is utilised for switching off the circular knitting machine 1. The switching position is assumed by the armature 45 when the filament monitoring arm 40 "pivots" from the operating position into the switching position. This is the case not only when the slide member is pulled to the left by the filament 9 on the slide wire 17 owing to excessive tension of the filament 9, but also when the filament breaks.

When the tension of the filament 9 is excessive, the latter withdraws the slide member from the magnet 25. Through the relatively long run-out, breaking of the filament owing to excessive tension is prevented; the "run-out", defined by the length of the slide wire 17, along which the slide member 21 can slide, is so dimensioned, that the circular knitting machine can be brought to a standstill before the slide member 21 reaches the bridge 15.

The arrangement of the contact tongues 54, 55 relative to the armature 45 is such that a certain attractive force is already present in the operating position, which represents a degree of pre-stressing. It can be further increased by providing metal members 60', e.g. screws, in further separate bores 60 in the block 42.

On its underside the block 42 has two apertures 61, through which the clamping screw 49 is accessible in an appropriate position of the armature 45 for assembly purposes. On the underside of the block 42 there is furthermore provided a control lamp 62. On one side of the block a stop stirrup 63 is provided which presents an abutment for the wire stirrup 40 in the switching position 59.

Excessive tension can always occur if the filaments adhere particularly firmly to the bobbins or to each other on account of their surface roughness and/or electrostatic attraction effects, or if they become twisted individually or intertwined, if the yarn is caused to pile up, jammed or otherwise held up owing to neps, thread ends or paraffin, etc. For this eventuality automatic release of the tension of the filaments is provided. When the sliding member 21 moves to the left, it pulls the piston 31 in the tube 18 to the right via the cable 28. The circular knitting machine is switched off; by means of an electrical and pneumatic circuit to be described hereinafter the chamber 32 to the right of the piston 31 is subjected to compressed air via the conduit 33 and the connection 34. The compressed air is supplied in short pulses, by which the piston 31 is pushed to the left (in FIG. 3) for brief periods. These pulsed tugs normally suffice for clearing any blockage of the filament. When normal conditions are restored by means of this tugging over brief periods, the piston 31 and the sliding member 21 are, respectively to the left and to the right, returned to their operating position shown in FIG. 3 by the compressed air pulse and the filament monitoring arm 40 is pivoted back into its operating position. The two reed switches 52 and 53 again open.

Figure 6:
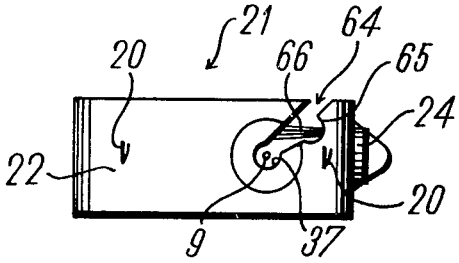
FIG. 6 is a plan view of the slide member, as used in FIGS. 1, 3, 4.

FIG. 6 shows the upper limb 22 of the slide member 21 with the eye 37. The aperture 36 is of similar construction. The filament 9 is threaded through a slot 64. One side of the slot 64 has a semi-circular recess 65 into which a small brush 66 is inserted in such a way that its free ends lie obliquely against the side of the slot 64 opposite the recess 65. Thus the filament 9 can be inserted into the slot 64 from the outside; the brush 66 however defines a stop preventing the filament 9 from slipping out accidentally and unintentionally. Moreover the filament is cleaned when it is inserted and it touches the brush 66 as it passes through the eyes 36 and 37. FIG. 7 shows the filament air brake 10. A plurality of such filament air brakes, viz. one for each yarn 9, are — as already mentioned — provided in the block 100 (FIG. 1). The filament air brake provides the filament with a certain amount of low and resilient tension. The filament therefore remains tensioned as it passes through. The tension is very low and uniform. What is accomplished thereby is, that a stream of air passes over the filament 9 in the opposite direction to the direction of movement of the latter, so that a uniform and low frictional force, which remains uniform and low even upon stressing of the filament 9 as by impact, is created between the airstream and the filament 9, which imparts the necessary tension to the latter. A block 67 (a plurality of blocks 67 form the block 100 in FIG. 1) is provided with a first bore 68 through which the filament passes. A further bore 69 opens into the bore 68 at an acute angle and in such a way that the compressed air admitted thereto flows through the bore 68 oppositely to the direction of movement of the yarn 9. The bore 69 is subjected to compressed air via a connection 70.

Figure 8:
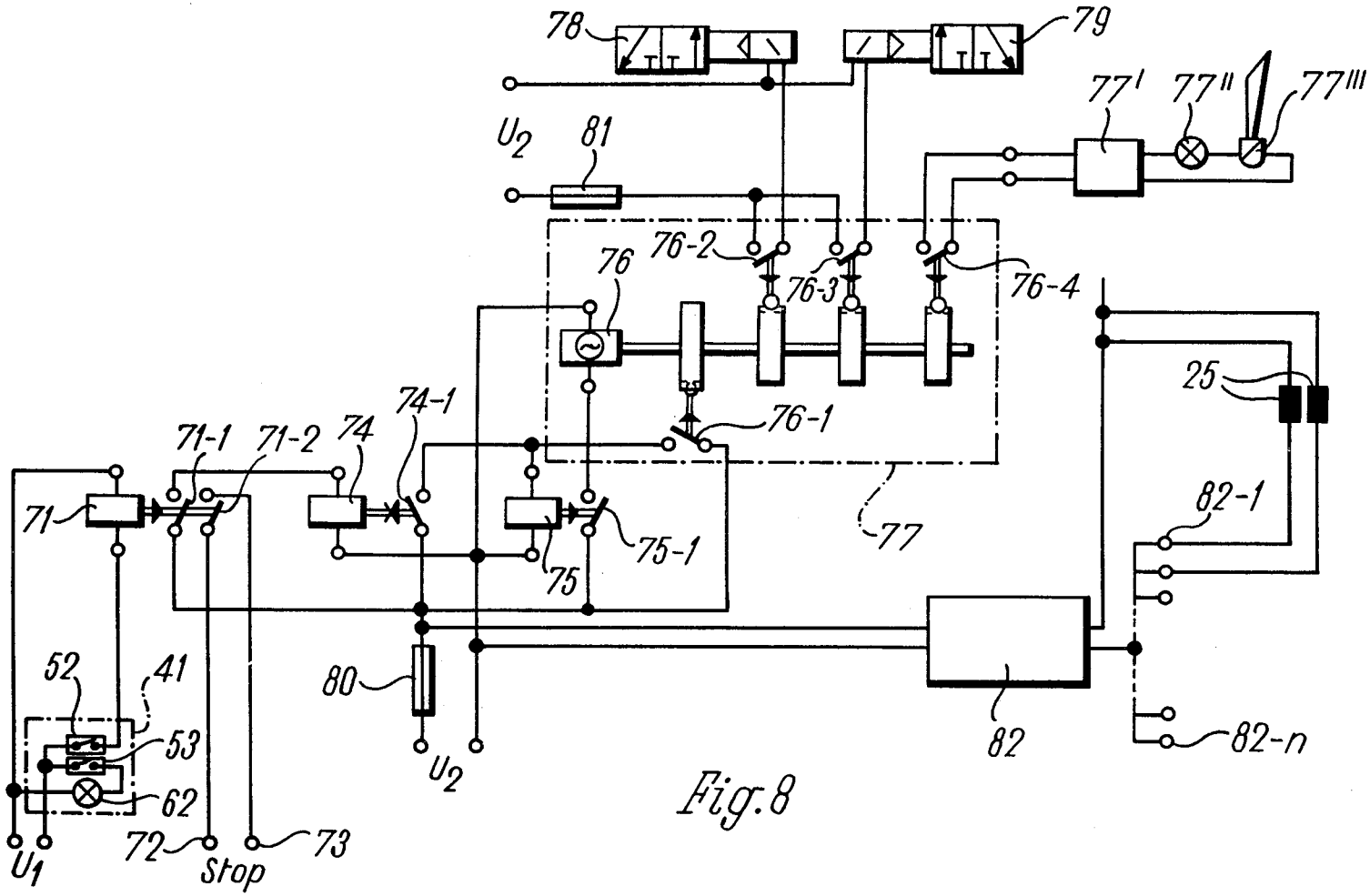
FIG. 8 shows the electric circuit of the embodiment according to FIG. 1.
Figure 9:
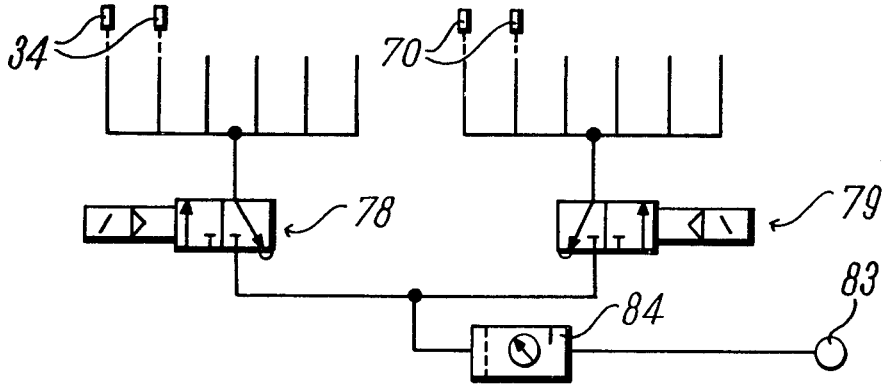
FIG. 9 shows the pneumatic circuit of the embodiment according to FIG. 1.

FIG. 8 shows the electrical, and FIG. 9 the pneumatic circuit for operating the yarn passage monitoring device 12. At the bottom of FIG. 8 on the left hand side the filament monitor 41 with the two reed-switches 52 and 53 can be seen. The voltage supply is provided by a voltage source $U_1$ (e.g. 24 V AC). The first reed-switch 52 is in series with a shut-down relay 71 for the machine; when it is closed, the machine shut-down relay 71 is energised. The second reed-switch is in series with the control lamp 62. The relative arrangement of the two reed-switches 52 and 53 may however be such that the reed-switch 53, which causes indication of the control lamp 62, closes slightly ahead of the reed-switch 52 when the filament monitoring arm 40 is pivoted. This is the case if it is arranged in the position 53'.

If, upon closure of the reed-switch 52, the machine shut-down relay 71 is energised, the contacts 71-1 and 71-2 close. In the operating position the contact 71-2 connects two connection terminals 72 and 73 with which the shut-down switch proper (not shown) for the circular knitting machine 1 is connected, which shuts down the latter instantly. Closure of the contact 71-1 causes the voltage $U_2$ (e.g. 220 V AC) to be applied to a normally-closed time delay relay 74, so that the contact 74-1 closes. Thereby the voltage $U_2$ is also caused to be applied to the further relay 75, so that its contact 75-1 closes. Thereby the motor 76 of a programming switch 77 is switched on. Initially the contact 76-1 is actuated and thus causes the relay 75 to remain energised in the course of rotation. The contact 76-2, by means of which a first, electromagnetically controlled, 2/2-way valve 78 is switched, is actuated next. As soon as this 2/2-way valve is switched, viz. as a result of closure of the contact 76-2, compressed air is admitted to the chamber 32 via the conduit 33 (see FIG. 3), so that the slide member 21 briefly, i.e. so long as the contact 72-2 is closed, "tugs" (see above) at the filament. Simultaneously or shortly thereafter the contact 76-3 which switches a second electromagnetically controlled 2/2-way valve 79, via which compressed air is admitted to the filament air brake 10 via its connection 70, is actuated. Thus, after the slide member 21 has been pulled away from its operating position and the circular knitting machine 1 has been brought to a standstill, the yarn is tensioned. The time for one revolution of the programming switch 77 is, for example, approximately five seconds. Thus, so long as the reed-switch 52 is closed, the programming switch is restarted after each revolution and each time results in a brief pulse of compressed air, determined by the switching time of the contacts 76-2 and 76-3, in the chamber 32 and at the filament air brake 10. This process continues until these pulses of compressed air or this "tugging" have again loosened the yarn and have restored the piston 31 and with it via its connection with the piston by means of the cable 28, the slide member 21 also, into the operating position shown in FIG. 3. When this has taken place, the programming switch 77 is not again switched on upon completion of one revolution.

The programming switch may have further switching facilities, e.g. it may energise a further contact 76-4, upon closure of which the counter 77' is supplied with a pulse. In known manner the counter may, when a predetermined counter condition (e.g. counter condition 10) has been reached, actuate a signalling lamp 77'' and/or an audible indication 77'''. In the circuit diagram according to FIG. 8, fuses are moreover shown and designated 80 and 81. Moreover the electric circuit comprises the electric current regulator 82 which has a plurality of outputs 82-1 to 82-n, which supply current to the magnets 25 associated with the individual filament monitoring devices. FIG. 9 shows the pneumatic circuit diagram. A source 83 of compressed air leads to the two 2/2-way valves 78 and 79 which are always shown in their rest position (reed switch 52 and 53 are open) by way of an adjustable pneumatic current regulating valve 84. The outputs of the two 2/2-way valves 78 and 79 are always connected by way of corresponding split connections with the connection 34 for the compressed air by way of which the spaces 32 in the piston guide rods 18, or with the contacts 70 for the compressed air, by way of which the air brakes 10 for the filaments are supplied.

Figure 10:
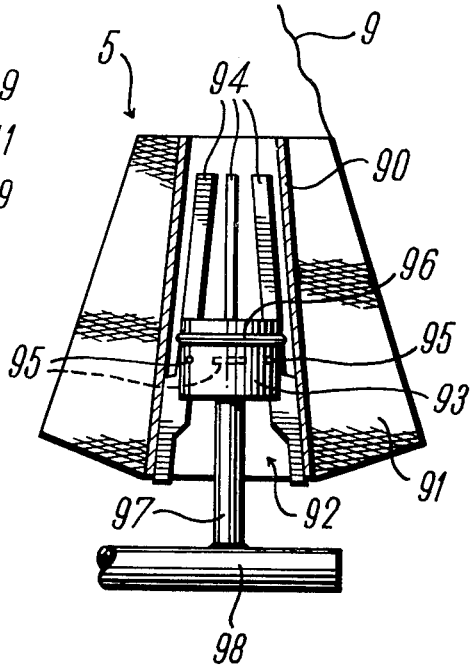
FIG. 10 shows a cross-section through a bobbin holder for the embodiment according to FIG. 1.

FIG. 10 shows the accommodation of a bobbin 5 in the bobbin creel 2. The bobbin 5 consists of a core 90 on which the body of the bobbin formed by the yarn has been wound up and from which the thread 9 is drawn off. The pick-up of the bobbin which generally has been designated by 92 is formed by cylindrical construction part 93 on which four holding arms 94 are attached rotatably with pegs 95. Above the rotating connection formed by the pegs 95 of the holding arms 94 on the construction unit 93 the holding arms 94 are compressed by an elastic band 96 which compresses the areas of the holding arms 94 located above the pegs 95 and thus the areas of the holding arms 94 located below the pegs 95 are forced apart and thus pressed from the inside against the cores 90 of the bobbin. In this manner, it is possible to put wound packages of various inside cross sections on the bobbin pick-up 92 and also to remove them from it without any trouble. The construction unit 93 is seated on a short piece of pipe 97 which has been welded on to an additional piece of pipe 98 which is a component of the bobbin creel 2.

Figure 2:
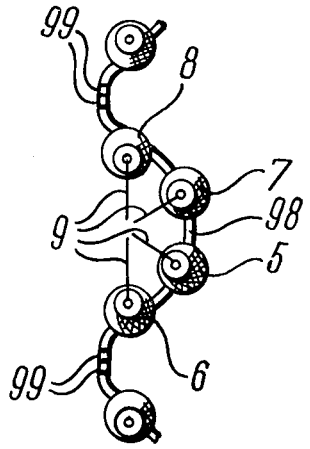
FIG. 2 shows a plan view of the embodiment according to FIG. 1 along the line II—II in FIG. 1.

As can be seen from FIGS. 1 and 2, the bobbin creel 2 is formed by the arrangement of several pieces of pipe 98 in a semicircular form one above the other in several planes and in that they are always welded together at their ends with a frame 99. At the same time, the piece of pipe 97 on which the contruction parts 93 have been disposed are directed slantingly upward on the semi-circular pieces of pipe 98 in such a way that they point essentially with the air thread brakes 10 in the direction of the block 100. Thus the yarns 9 can be pulled off the bobbins without the danger of a mutual adherence and without mutually disturbing each others paths and without any further guiding arrangement. As a result of that it will be possible to dispose in one bobbin creel 2, always so many bobbins (two each for one yarn), that the necessary number of bobbins can be accommodated side by side in regard to space below an arrangement of several filament monitoring devices.

Figure 11:
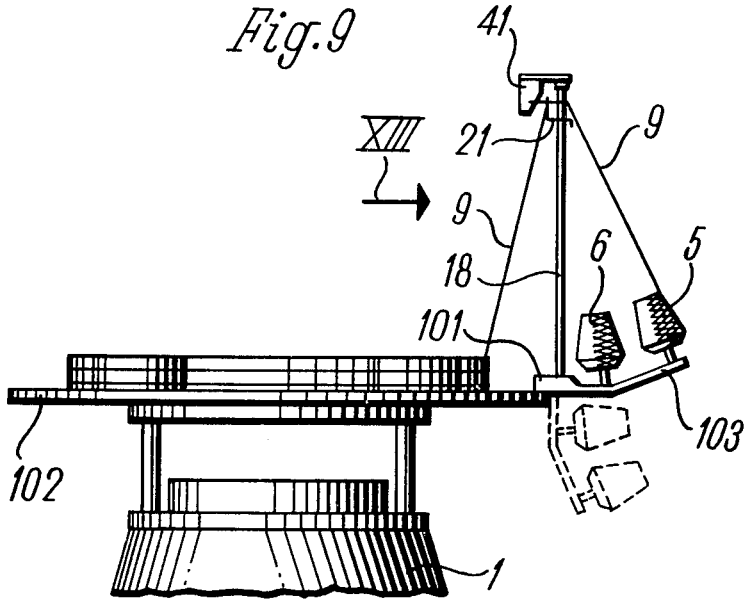
FIG. 11 shows a second embodiment.
Figure 12:
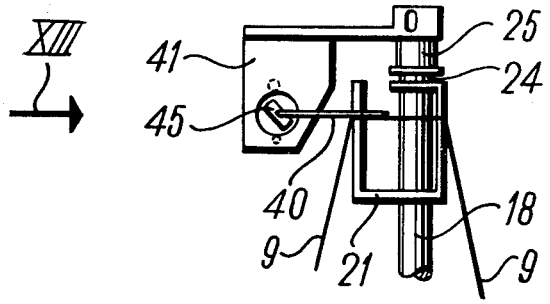
FIG. 12 shows a detail of the embodiment according to FIG. 11.
Figure 13:
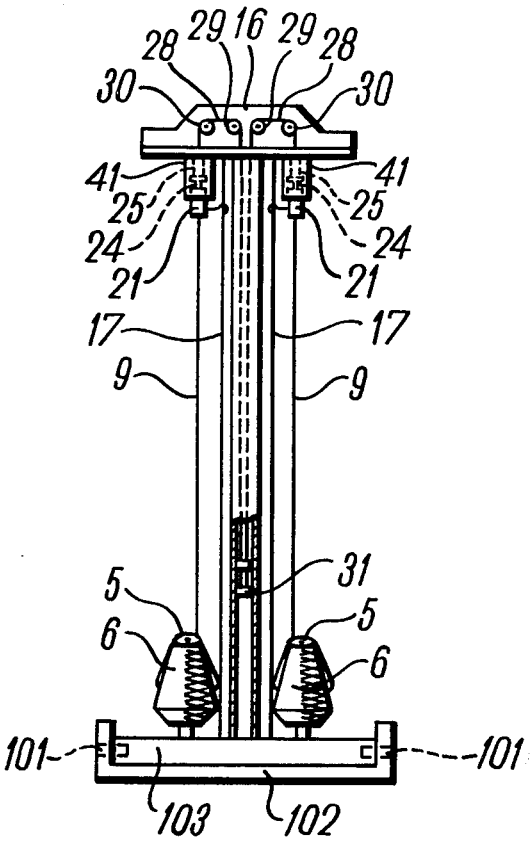
FIG. 13 is a view of the embodiment according to FIG. 11 in the direction of the arrow XIII shown in the latter.

The FIGS. 11, 12 and 13 show a modification of the embodiment according to FIG. 1. It differs from the FIG. 1 embodiment in that instead of the fixed jib 14 a platform 102 is mounted, on the circular knitting machine 1, wherein several twin filament monitoring devices are disposed swivelably upwards. The entire arrangement is supported by the piston guide pipe 18, which is attached on a bridge 103 which at point 101 constitutes a rotating connection with the platform 102. The filament monitoring device can be swiveled down from the swiveled up position shown in solid lines in FIG. 11 into the position indicated with broken lines, whereby the swiveled down position is defined by a stop of the bridge 103 on the front side of the platform 102. The bridge 103 carries twice two bobbins, namely two bobbins 5 and two bobbins 6 (cf. FIG. 13), whereby always one yarn 9 is drawn off, each time, one pair of bobbins 5, 6 similarly as in FIG. 1. As can best be seen from FIG. 13, always two guiding elements 21 are connected in the piston guide pipe 18 with a single piston 31 always by way of a string 28 which is guided across the reversing rolls 29, 30, which are likewise provided in pairs. Otherwise, the reference numbers and the method of functioning of the embodiment according to FIGS. 1–9.

As can be seen from FIG. 11, the great advantage of such an arrangement is the enormous saving of space in that the area immediate to the circular knitting machine 1 is unoccupied and is therefore free for other uses. The filament monitoring device and the occupy any additional space around the machine. At the same time, however, the enormous disadvantage of hitherto known arrangements is omitted, where the filament monitoring device and the bobbins are disposed at a height, necessitating the awkward threading from ladders or with long poles which in the case of the arrangement according to the invention is obviated, because for the threading and servicing etc., a swinging down of the bobbin into an area approachable from the floor has been provided.

If, therefore, a breakdown occurs which must be corrected, then that filament monitoring device at which the breakdown has occurred (indicated by the control lamp 62) and inclusive of the bobbins, is swung down and the filament monitoring device is again swung up. Therefore, the space requirement associated with conventional bobbin creels and filament monitoring devices is eliminated. This saving in space can amount to up to 50% of the normal requirement for space.

I claim:

1. A filament monitoring device for a knitwear manufacturing machine having an energizable drive drive therefore, the device comprising a filament guide for conducting a filament therethrough and arranged to be guided out of an operating position thereof when a predetermined filament tension is exceeded thereby causing the machine drive to be deenergized, a compressed air cylinder, a return piston reciprocable in said cylinder and arranged to return the filament guide into said operating position in such a manner as not to break the filament, means for automatically reenergizing the machine drive when said filament guide has been returned into said operating position, a slide member, a tie member connecting said slide member to said piston, means for guiding said slide member into and out of said operating position and magnet means including an armature for holding said slide member in said operating position when said filament tension is below a predetermined value, said slide member carrying only said filament guide and said armature.

2. A device according to claim 1, wherein said means for guiding said slide member into and out of said operating position is defined by an elongate slide element.

3. A device according to claim 1, wherein said slide member has a pair of limbs defining a substantially U-shape and is arranged so that, in use of the device, the filament extends from one said limb to the other, and including a filament monitoring arm arranged to sense the filament between said limbs.

4. A device according to claim 4, wherein said tie member extends through said magnet and is secured to said armature.

5. A device according to claim 1, wherein said compressed air cylinder is arranged with its axis parallel to the path of said slide member.

6. A device according to claim 1, wherein there are two slide members connected by a said tie member to a common said piston.

7. A device according to claim 1, wherein said filament guide is in the form of an eye which has an opening on one side and including a brush arranged, to prevent the filament from slipping out of the eye.

8. A device according to claim 1, including means arranged, to cause an air current to flow in the opposite direction to the direction of movement of the filament to brake and tension the filament before it passes through said slide member.

9. A device according to claim 1, wherein said tie member is defined by a cable.

* * * * *

UNITED STATES PATENT AND TRADEMARK OFFICE

CERTIFICATE OF CORRECTION

PATENT NO. : 4,016,732

DATED : April 12, 1977

INVENTOR(S) : Eberhard Merkle

It is certified that error appears in the above-identified patent and that said Letters Patent are hereby corrected as shown below:

Column 7, Line 68, after "the" (second occurrence) should be -bobbins assigned to it, in operating position does not- Signed and Sealed this

*ninth* Day of *August 1977*

[SEAL]

*Attest:*

RUTH C. MASON
*Attesting Officer*

C. MARSHALL DANN
*Commissioner of Patents and Trademarks*